US007726139B2

(12) United States Patent
Maier-Laxhuber

(10) Patent No.: US 7,726,139 B2
(45) Date of Patent: Jun. 1, 2010

(54) COOLING SORPTION ELEMENT WITH GAS-IMPERMEABLE SHEETING

(75) Inventor: Peter Maier-Laxhuber, Pfaffenhofen (DE)

(73) Assignee: ZEO-TECH Zeolith-Technolgie GmbH, Unterschleissheim (DE)

( * ) Notice: Subject to any disclaimer, the term of this patent is extended or adjusted under 35 U.S.C. 154(b) by 896 days.

(21) Appl. No.: 11/361,478

(22) Filed: Feb. 24, 2006

(65) Prior Publication Data

US 2006/0191287 A1 Aug. 31, 2006

(30) Foreign Application Priority Data

Feb. 25, 2005 (DE) ..... 10 2005 009 167
Jul. 22, 2005 (DE) ..... 10 2005 034 297

(51) Int. Cl.
*F25B 15/00* (2006.01)

(52) U.S. Cl. ..... 62/101; 62/294

(58) Field of Classification Search ..... 62/60, 62/100, 101, 293, 294, 476, 480, 484, 497; 96/147, 134, 135, 153, 154
See application file for complete search history.

(56) References Cited

U.S. PATENT DOCUMENTS 2,554,879 A * 5/1951 Race, Jr. ..... 96/117.5
3,540,963 A * 11/1970 Dipner ..... 156/244.24
4,479,364 A 10/1984 Maier-Laxhuber
4,660,629 A 4/1987 Maier-Laxhuber et al.
4,674,563 A 6/1987 Maier-Laxhuber et al.
4,752,310 A 6/1988 Maier-Laxhuber et al.
4,802,341 A 2/1989 Maier-Laxhuber et al.
4,924,676 A 5/1990 Maier-Laxhuber et al.
4,956,977 A 9/1990 Maier-Laxhuber et al.
5,024,594 A * 6/1991 Athayde et al. ..... 442/67
5,038,581 A 8/1991 Maier-Laxhuber et al.
5,050,403 A 9/1991 Maier-Laxhuber
5,054,544 A 10/1991 Maier-Laxhuber et al.
5,207,073 A 5/1993 Maier-Laxhuber et al.
5,359,861 A 11/1994 Maier-Laxhuber et al.
5,404,728 A 4/1995 Maier-Laxhuber
5,415,012 A 5/1995 Maier-Laxhuber et al.
5,440,896 A 8/1995 Maier-Laxhuber et al.
5,482,541 A 1/1996 Maier-Laxhuber et al.
5,518,069 A 5/1996 Maier-Laxhuber et al.
5,593,482 A * 1/1997 Dauber et al. ..... 96/117.5
5,816,069 A 10/1998 Ebbeson
5,992,700 A * 11/1999 McGlothlin et al. ..... 222/187
6,341,491 B1 * 1/2002 Paine et al. ..... 62/4
6,349,560 B1 2/2002 Maier-Laxhuber et al.
6,378,326 B2 4/2002 Maier-Laxhuber et al.

(Continued)

FOREIGN PATENT DOCUMENTS

WO WO 01/10738 A1 2/2001

*Primary Examiner*—Mohammad M Ali
(74) *Attorney, Agent, or Firm*—Hoffman & Baron, LLP

(57) ABSTRACT

A cooling element with a sorbent material (4) which in vacuo can sorb a vaporous working medium that evaporates from a fluid working medium in an evaporator (29) and with a shut-off means which, up to the moment at which the cooling process is initiated, prevents the working medium vapor from flowing into the sorbent material (4), with the sorbent material (4) being sealed into a sorbent-containing pouch (22) which comprises a multilayer sheeting material which in turn comprises at least one metallic layer or one metallized layer.

15 Claims, 7 Drawing Sheets

U.S. PATENT DOCUMENTS

| | | | | |
|---|---|---|---|---|
| 6,412,295 | B2 | 7/2002 | Weiss et al. | |
| 6,474,100 | B1 | 11/2002 | Smith et al. | |
| 6,820,441 | B2 | 11/2004 | Maier-Laxhuber et al. | |
| 7,306,659 | B2 * | 12/2007 | Gorton et al. | 96/134 |
| 2002/0104319 | A1 * | 8/2002 | Paine et al. | 62/4 |
| 2002/0127442 | A1 * | 9/2002 | Connor et al. | 429/12 |
| 2004/0072332 | A1 * | 4/2004 | Suzuki et al. | 435/262 |
| 2004/0211215 | A1 | 10/2004 | Maier-Laxhuber et al. | |
| 2004/0258864 | A1 * | 12/2004 | Triebold et al. | 428/35.2 |
| 2005/0061022 | A1 | 3/2005 | Maier-Laxhuber et al. | |

* cited by examiner

COOLING SORPTION ELEMENT WITH GAS-IMPERMEABLE SHEETING

FIELD OF THE INVENTION

The present invention relates to a cooling sorption element with a gas-impermeable sheeting, wherein cold is generated by means of evaporation of a working medium and subsequent in vacuo sorption of the working medium vapor in a sorbent material and to a method for producing and activating these cooling elements.

BACKGROUND OF THE INVENTION

Adsorption devices are apparatuses in which a solid adsorbent material sorbs a second medium which boils at a lower temperature, the so-called working medium, in the form of a vapor while releasing heat (sorption phase). In the course of this process, the working fluid evaporates in an evaporator while sorbing heat. After the sorbent material is saturated, it can be re-desorbed when heat at higher temperatures is added to it (desorption phase). At that time, the working medium evaporates from the adsorbent material. The working medium vapor can be recondensed and can subsequently be re-evaporated in the evaporator, etc.

Absorption devices are apparatuses in which a liquid absorbent material is used. The broader term "sorption devices" includes both adsorption and absorption systems.

Adsorption apparatuses for cooling with solid sorbent materials are known from EP 0 368 111 and from DE-OS 34 25 419. Sorbent containers filled with sorbent materials draw off the working fluid medium which forms in an evaporator and sorb it while releasing heat. This heat of sorption must be dissipated from the sorbent. The cooling devices can be used for cooling and heating food products in thermally insulated containers.

WO 01/10738 A1 describes a self-cooling beverage can in which an evaporator is disposed inside and a sorber outside the can. Cooling is initiated by opening a vapor passageway between the evaporator and the sorber. Via the surfaces of the evaporator, the cold generated in said evaporator is transferred to the beverage to be cooled inside the can. The heat generated in the sorbent material is stored in a heat buffer. Compared to a conventional can, this self-cooling beverage can is modified considerably and is expensive to manufacture.

Additional theoretical embodiments of self-cooling assemblies are listed in WO 99/37958 A1. None of these devices can be implemented and produced inexpensively.

U.S. Pat. No. 6,474,100 also describes a self-cooling cooling element disposed on the outer surface of a pouch for holding liquids or bulk products. The sorbent material is enclosed in a flexible, multilayered sheeting material. Contact with the hot sorber filling is reduced to a minimum by insulating and flow materials as well as by heat-storage materials interposed in between. The temperature compensation between the hot sorber filling and the cold evaporator, large surfaces of which face each other, has to be reduced by means of a complicated insulating system.

SUMMARY OF THE INVENTION

The problem to be solved by the present invention is to make available inexpensive cooling sorption elements for generating cold as well as a method for producing same.

During the sorption process, sorbent materials may reach temperatures of more than 100° C. The multilayered sheeting materials used in the packaging industry are not suitable for such high temperatures. Especially the polyethylene layers used for sealing soften at a temperature as low as 80° C. and cause the covering layer to become permeable in vacuo. A sealing layer made of polypropylene, on the other hand, is able to withstand considerably high temperatures. Its melting point is higher than 150° C.

In combination with high temperatures, sharp edges, corners and pointed tips of sorbent granules lead to inadmissible leaks. This risk is eliminated according to the present invention by using a minimum of one polyester layer within the multilayer sheeting material. Polyester sheeting materials are especially tear- and puncture-resistant. The actual gas barrier is implemented by a layer of a thin metal sheeting material or a metallized layer. For this purpose, it proved to be useful to employ thin aluminum foil layers with a layer thickness of approximately 8 μm. Metallized plastic sheeting materials are less impermeable. If the length of storage time is short, however, it is possible to use these metallized sheeting materials as well, especially since they can be produced less expensively than the metal sheeting materials.

The separate layers of a multilayer sheeting material are joined to one another by means of adhesive layers. Commercially available adhesives contain solvents which, during bonding, are not completely removed from the adhesive layer. Over relatively long periods of time, these solvents diffuse through the inner-lying layers, in particular the polyethylene layer, and have a negative effect on the vacuum inside the cooling element. The diffusion increases at higher temperatures, such as are observed during the sorption and production process of the cooling elements. The adhesives used therefore must also be designed to be able to resist high temperatures.

According to the present invention, the multilayer sheeting materials used have a polyester layer thickness of 12-50 μm, an aluminum layer thickness of 6-12 μm, and a polypropylene layer thickness of 50-100 μm. Such sheeting materials are used, e.g., for packaging food products which after packaging are sterilized at temperatures of more than 120° C. so as to preserve them.

Even more stable multilayer sheeting materials are obtained when an additional polyester layer with a thickness of approximately 15 μm is glued between the aluminum layer and the polypropylene layer. In this case, sharp-edged or sharply pointed sorbent components are unable to advance to the gas barrier, i.e., the aluminum layer.

Multilayer sheeting materials are available, e.g., from the firm of Wipf AG in Volketswil, Switzerland. The use of such sheeting materials makes it possible to ensure leakage rates of less than $1\times10^{-7}$ mbar l/sec. Thus, a storage ability over several years is ensured, without impairment to the cooling ability.

In the food industry, the steps of heat-sealing of multilayer sheeting materials to form pouches and filling bulk materials into such pouches and subsequently evacuating them are part of prior art.

In said industry, pouches in a very large number of sizes and shapes are used. Especially worth mentioning are stand-up pouches, pouches with pour openings, pouches with cardboard reinforcement, easy-tear pouches, peel pouches for easier opening, and pouches with valves. All of these pouches with their specific properties can be used to advantage for the cooling elements according to the present invention.

When filling a solid sorbent material into pouches, dust is generated, which dust is deposited on the inside surfaces of the sheeting material. Dust on the future sealing surfaces can lead to leaks if the layer of dust is excessively thick with respect to the polypropylene layer. Polypropylene layer thicknesses between 50 and 100 μm suffice to melt fine dust particles securely and hermetically into the polypropylene layer.

The use of sheeting materials according to the present invention makes it possible to directly enclose in vacuo hot, sharp-edged and dust-releasing sorbent material without additional protective intermediate layers and to store it over a period of several years, without foreign gases which interfere with or even completely prevent the sorption reaction being able to advance from the sheeting material as such or through said material into the cooling element.

The sorbent material preferably used is zeolite. In its normal crystal structure, said zeolite can reversibly sorb up to 36 wt % water. When used according to the present invention, the industrially feasible ability to absorb water is in a range from 20-25%. Zeolites continue to have a remarkable ability to sorb water vapor even at relatively high temperatures (above 100° C.) and therefore are especially suitable for the application according to the present invention.

Zeolite is a crystalline mineral which contains silicon and aluminum oxides in its skeletal structure. This highly regular skeletal structure contains cavities in which water molecules can be sorbed while releasing heat. Within the skeletal structure, the water molecules are subjected to high field forces, the strength of which depends on the quantity of water contained in the skeletal structure and on the temperature of the zeolite.

Natural types of zeolite occurring in nature take up markedly less water. Per 100 g of natural zeolite, only 7-11 g of water are sorbed. This reduced ability to sorb water is attributable to the specific crystal structures of said zeolites, on the one hand, and to the nonactive impurities of the natural product. As a result, the use of synthetic zeolites with their higher sorbability is to be preferred for cooling elements which, during a relatively long cooling period, are also able to release heat of sorption via the outer covering layer. According to the present invention, natural zeolites are used for cooling elements with a high cooling capacity and/or a short cooling time during which the sorbent material remains relatively hot. The reason is that at high temperatures of the sorbent material, synthetic zeolites no longer have an advantage over natural zeolites. Typically, in cases of a retarded release of the heat of sorption and, associated with this, high temperatures of the sorbent material of more than 100° C., both types are able to sorb only 4-5 g of water vapor per 100 g of dry sorbent material. In this specific case, the use of the natural zeolites is economically even preferable since their price is considerably lower.

Natural zeolites have yet another advantage. The nonactive admixtures are typically in a range from 10-30%. Thus, they are not actively participating in the generation of cold, but they are still heated by the neighboring zeolite crystal. As a result, they serve as an additional built-in, inexpensive heat buffer. This has the effect that the zeolite filling becomes less hot and thus is able to sorb additional water vapor at lower temperatures.

Natural zeolite granules consist of broken and crushed fragments and therefore have sharp-edged and sharply pointed geometric shapes which, in vacuo and at increased temperatures, can pierce or cut through the outer covering layer.

Another disadvantage of natural, but also of synthetically produced, zeolites is that, depending on their occurrence and the mining techniques used, they contain impurities which, in vacuo and especially at higher temperatures, release gaseous components that have a negative effect on the cooling process.

This problem of gas release is solved in that prior to producing the cooling element, natural zeolites are heated to at least the future temperature of the sorbent material and are subsequently subjected to a vacuum. According to the present invention, in the course of this procedure, zeolites are able to release the interfering impurities. This thermal treatment is especially effective if the previously sorbed water can be evaporated at the same time. To be able to carry out this treatment at increased temperatures and to withstand the sharp-edged corners and sharply pointed tips, gas-impermeable multilayer sheeting materials with an inner polypropylene layer and a minimum of one polyester layer are used according to the present invention.

Of the approximately 30 different natural zeolites, the following can be advantageously used for the cooling elements according to the present invention: clinoptilolite, chabazite, mordenite and phillipsite.

Substances occurring in nature can also be returned to nature without worry about environmental regulations. After their use in cooling elements, natural zeolites can be used, e.g., as soil conditioners, as liquid-binding agents, or to improve the quality of the water in stagnant bodies of water.

Among the synthetic types of zeolites, the use of types A, X and Y in their inexpensive Na form is recommended.

In addition to the combination of zeolite and water, other solid sorbent material combinations are also possible for use in cooling elements according to the present invention. Especially worth mentioning are bentonites and salts which, together with water as the working medium, constitute suitable combinations. Even activated charcoal in combination with alcohols can offer an advantageous solution. Since these material combinations also work at a reduced pressure, they can be sealed into the multilayer sheeting materials according to the present invention.

According to the present invention, the quantity of sorbent material used should be dimensioned and disposed in such a way that the inflowing water vapor needs to overcome only a minimum pressure drop within the sorbent material. Especially when water is used as the working medium, the pressure drop should be less than 5 mbar. Furthermore, the sorbent material should have a sufficiently large surface for the inflowing working medium vapor to accumulate on. To ensure uniform sorption within the sorbent material as well as a low pressure drop, it was found that sorbent granules are especially useful. The best results were obtained with granule diameters between 3 and 10 mm. Such granules can be readily packed in pouches made of the sheeting material. After evacuation, said pouches form a hard, pressure-resistant and dimensionally stable sorbent container which retains the shape forced on it during the evacuation. Also of advantage are, however, stable, shape-retaining zeolite blocks preshaped from zeolite powder, with flow passageways already incorporated into them and in shapes that conform to the geometry of the desired cooling elements. In the area of the future opening for vapor, the stable zeolite blocks may have hollow spaces which facilitate the cutting of the sheeting material by means of a cutting tool and which are able to retain the punched-out piece of sheeting material so as to not inhibit the flow through the vapor passageway.

During the sorption reaction, heat of sorption which heats the sorbent material is released. At higher temperatures of the sorbent material, the sorbability for water decreases markedly. To maintain a high cooling capacity over a longer period of time, it is recommended that the sorbent material be cooled.

On direct contact of the sorbent material with the multilayer sheeting material, heat of sorption that forms can be dissipated unimpeded through the sheeting material to the outside. As a rule, the heat will be dissipated to the surrounding air. Another highly effective way to cool the sorbent material container is to use fluids, in particular water.

Since the heat transfer to an air flow from the outside of the sorbent-containing pouch is within the same range as the heat transfer from sorbent material granules to the inside of the pouch, it is recommended that large sheeting material surfaces without fluting, such as cylindrical, platelike or tubular geometries, be used. Since especially zeolite granules have a low heat conductibility, the sorbent containers should be designed so that the average heat conduction path within the sorbent material does not exceed 5 cm.

The cooling elements according to the present invention can be classified according to the following fields of application: a) Rapid cooling of a liquid (e.g., cooling an 0.75 L champagne bottle from 25° C. to 8° C. within a period of 15 min); b) Long-term cooling of an air flow (e.g., cooling an air flow in a respiratory air cooler); c) Keeping beverages and food products cold and/or warm (e.g., keeping a meal warm while simultaneously keeping a previously cooled beverage cold over a relatively long transport time); and d) Delaying the thawing process of a frozen product (e.g., keeping an ice cream container cold (below −10° C.) after removal from the freezing compartment up to the subsequent consumption or during transport).

The cooling elements according to the present invention can meet the requirements demanded by practically all of these different applications. All applications are marked by the fact that a cooling element is stored at a given temperature over an indefinite period of time. To initiate the cooling effect, the shut-off means is activated at the time desired. Beginning at this point in time, working medium vapor can flow to and accumulate in the sorbent material. The sorbent material adsorbs the vapor within its crystal structure. The evaporator cools down and can be used as a refrigeration source. In applications that require rapid cooling (e.g., cooling of a liquid), the time will generally not be long enough to substantially cool the sorbent material. The ability to sorb working medium vapor will therefore be limited because of the high temperatures of the sorbent material unless admixtures serve as heat buffers.

With a cooling element having a longer cooling time, the sorbent material will be able to dissipate heat via the multilayer sheeting material and, depending on the application, transfer this heat at a higher temperature level to a product that is to be kept warm.

In applications in the freezing temperature range, sufficiently large flow passageways and possibly additives to the working fluid that lower the freezing point will have to be considered.

To minimize the heat flow from the hot sorbent material to the cold evaporator, it is necessary to either provide for insulating materials or, as proposed by the present invention, to ensure that the two components are spatially sufficiently separated.

Especially inexpensive cooling elements can be obtained if the evaporator is also sealed into a gas-impermeable sheeting material. In vacuo, the flow passageways to the sorbent material must be retained. For this purpose, the present invention provides for spacers which allow the working medium vapor to unimpededly dissipate from the working fluid and, at the same time, ensure good thermally conducting contact between the cold surfaces and the sheeting material.

For this purpose it is also of advantage to use flexible spacers made of a plastic material, which spacers are adapted to the cooling application at hand. A prerequisite, however, is that the plastic spacers do not outgas during the storage time and thus have a negative effect on the vacuum. It is recommended that the plastic used for this purpose be polycarbonate or polypropylene since these materials can be heated to high temperatures and thus be outgassed prior to or during the manufacturing process. It is of special advantage if this increase in temperature takes place at the same time that the sorbent material is heated during the manufacture of the cooling element.

Spacers made of a plastic material can be inexpensively manufactured using conventional manufacturing methods, such as thermoforming, extrusion or blow molding. It is recommended that care be taken to ensure that no materials that will outgas at a later point in time, such as softening agents, are added during the manufacturing process.

The cooling elements can also be classified according to the shut-off means used: e) The vapor passageway from the evaporator to the sorbent material is opened (e.g., by piercing a pouch which is made of the sheeting material and which encloses the sorbent material); and f) The fluid line from a storage tank to the evaporator is opened (e.g., by bursting a water-containing pouch and allowing the water to be discharged into the evaporator). From there, it evaporates and flows on to the sorbent material.

In the first example, the multilayer sheeting material enclosing the sorbent material can be pierced. For this purpose, it is suitable to use sharp-edged cutting tools which cut a sufficiently large hole into the sheeting material. The cutting tool can be activated both from the side of the sorbent material and from the side of the evaporator. Since the sheeting materials according to the present invention are flexible, the cutting tool is actuated according to the present invention by a deformation exerted on the sheeting materials from the outside. In this manner, it is possible to design the shut-off means inexpensively and actuate them gas-impermeably.

In all cases, the cutting tool must be sufficiently sharp-edged to cut the sheeting material through the cross section required. Suitable for this purpose are, for example, cylindrically shaped expanded metals or sharp-edged injection-molded components made of a plastic material which, in addition, are also able to squeeze or move the sorbent material behind the sheeting material so as to securely cut through the sheeting material.

The same principle obviously also applies to shut-off means (scenario f) that need to provide only a small opening for the pouch made of the sheeting material and containing the fluid working medium. According to the present invention, an additional pouch made of the sheeting material and containing the appropriate quantity of working medium and having a connecting passageway can be molded onto the evaporator sheeting material. According to the present invention, the passageway disposed between the sorbent material and the fluid working medium can be shut off by providing that the sheeting material has one or more kinks in this area, thereby compressing the polypropylene layers to one another. In combination with the air pressure exerted from the outside, this measure leads to a sufficient seal between the pouch containing the working medium and the evaporator. The kinked passageway thus forms a closed fluid valve. To open said passageway, the sheeting material in the area of the passageway is simply folded back into its original shape, and the working medium is optionally pressed into the evaporator by exerting pressure on the pouch containing the working medium.

Another useful embodiment is obtained by inserting a separate pouch containing fluid working medium into the evaporator. By means of external pressure on the covering material of the evaporator, the pouch containing the working medium can be made to burst, thus allowing the fluid working medium to flow, e.g., into a nonwoven evaporator. In this case, the torn-open leakage site forms the fluid valve.

According to other embodiments, the evaporator in combination with the sorbent material can be disposed inside the sorbent-containing pouch. Only when the fluid valve allows the working medium to enter the evaporator is it possible for the working medium to evaporate from said evaporator and to flow in the form of a vapor into the sorbent material. The advantage of this type of shut-off means is that only a relatively small cross section must be opened for the fluid working medium to be able to flow through. The disadvantage, on the other hand, is that the working medium must homogeneously wet the evaporator at a sufficiently rapid speed, without being entrained in liquid form into the sorber or possibly even turning into ice as it exits the opening, which would block the further inflow.

As known, it is possible to prevent the working medium, here water, from turning to ice by admixing an agent that reduces the freezing point. An addition of common salt, e.g., can lower the freezing point down to −17° C. It suffices if the freezing point-lowering agent is simply disposed around the discharge opening of the water pouch. Only when the water exits from the opening is it mixed with the highly concentrated freezing point-lowering agent. Thus, the possibility of the water solidifying is thereby avoided. Next, the subsequently exiting water dilutes the solution and transports the working medium into all areas of the evaporator.

A homogeneous distribution of the working medium can also be implemented by means of a separate, finely branched passageway structure which homogeneously distributes the working medium after said working medium has passed through the shut-off means and before it could be entrained in liquid form by the vapor flow. Such a distribution can be inexpensively implemented by means of a layer of a finely perforated sheeting material which is disposed around the discharge opening.

Only in exceptional cases will the working medium be present in the evaporator in uncombined form. In most cases, it is distributed in an absorptive nonwoven material where it is retained by means of hygroscopic forces. Particularly inexpensive materials are absorptive papers, such as are used in many different varieties in households and industry for absorbing liquids. Like the spacers made of a plastic material or natural zeolite, the water-storing nonwoven materials should not outgas in vacuo or at high temperatures. It was found that commercially available microfibers made of polypropylene were especially suitable for this purpose. The fibers are designed to absorb water and do not emit any gases that can interfere with the vacuum.

Another solution proposed is the fixation of the working fluid in organic binding agents, e.g., in water lock of Grain Processing Corp., USA. A combination of several of the measures mentioned above may also be useful.

According to the present invention, to quickly cool a fluid in a fluid container, the outer surface of the fluid container is pressed to the evaporator surface of the cooling element. This can be very effectively implemented by disposing the fluid container directly within the evaporator sheeting material. As a result of the negative pressure between the multilayer sheeting material and the fluid container, it is possible for the spacer to press the nonwoven material at a high compressive force onto the surface of the container and thus utilize a large portion of the sometimes highly structured surface of the container for the transfer of heat.

This assembly, however, is to be recommended only if the container material as such does not emit any gas and a potentially existing closure for the future discharge of the beverage is sufficiently leakproof. If this cannot be ensured or if the outer surface of the assembly has gassing labels glue to it, the fluid container as such is first heat-sealed in vacuo into a gas-impermeable outer sheeting material. This gas-impermeable packaging can subsequently be directly disposed within the evaporator outer cover sheeting. In contrast to the multilayer sheeting material which surrounds the sorbent material, the outer cover sheeting for the fluid container need not be able to withstand high temperatures. Thus, it is possible to use, e.g., thin metallized sheeting materials with a more readily processible polyethylene layer.

Yet another solution according to the present invention provides that the evaporator structure be kept flexible and that the cold surface of the outer evaporator cover sheeting be pressed by means of a separate elastic compression means over a large surface of the outer surface of the fluid container. Suitable externally disposed elastic compression means are stretch or shrink wraps or rubber bands. The advantage of this approach is that the fluid container remains partially visible and that the cooling element does not need to be opened to pour out the fluid. A disadvantage, however, is the inferior heat transfer since gaps that impede the transfer of heat can remain between the outer surface of the container and the outer evaporator covering material.

To maintain the necessary vapor passageway cross section between the evaporator and the sorbent filling in spite of the externally exerted air pressure, this invention provides that the vapor passageway be formed and stabilized by multiple layers of a plastic network. Thus, a sufficient cross section for the flow remains intact between the network structure. When polypropylene networks are used, higher temperatures are admissible without the risk of a release of gases. Furthermore, since the networks have a flexible structure, they adapt optimally to any geometry involved.

In this context, the term fluid container is meant to comprise all known and conventionally used containers, such as bottles, cans, pouches, jugs, cardboard packaging, etc., that serve to hold liquids, such as beverages, liquid drugs, and chemical products. Obviously, the fluid container may also contain solid or freely flowable products. The normal shape and structure of the fluid container does not need to be changed in any way. Thus, all manufacturing and filling devices used so far can be used without requiring any changes.

The evaporator can have any shape and can be manufactured from any materials. An industrial requirement is that a sufficiently large opening for allowing the water vapor to flow into the sorbent material forms and is maintained during the cooling process, that working fluid in a liquid state remains in the area to be cooled, that an entrainment of liquid components is prevented, and that an excellent thermal connection to the object to be cooled is maintained.

Of industrial and economic interest are, e.g., cooling elements in the shape of trays for the transport of food with adjacent hot and cold surfaces. These can preferably be designed in the form of bowls into which the food can be placed directly. Also useful are cooling elements in which the hot and cold surfaces are disposed opposite to each other. Such elements can be optimally used to separate warm and cold areas in coolers or insulating transport packagings. In these cases, an insulating spacer material can be inserted between the hot and the cold zone, which spacer material can preferably be disposed inside the multilayer sheeting material. Disposing such cooling elements in vacuo additionally reduces the heat conduction in a highly effective manner.

To produce cooling elements according to the present invention, for example, a unilaterally open sorbent-containing pouch is manufactured from a multilayer sheeting material by means of heat sealing. The sorbent-containing pouch is filled with a sorbent material which contains a low quantity of working medium and does not contain gases that will be released at a later time, it is subsequently evacuated to a pressure of less than 15 mbar, in particular to less than 5 mbar, and then heat-sealed so as to be impermeable to gas. Subsequently, the pouch containing the sorbent material and being under a vacuum, together with a shut-off means, a spacer and a nonwoven evaporator that is saturated with the working medium, is wrapped into another outer pouch made of a multilayer sheeting material. The outer pouch is subsequently evacuated in a vacuum chamber until it reaches the vapor pressure of the working medium and subsequently also sealed so as to be impermeable to gas. When incorporating the shut-off means, care must be taken to ensure that its opening mechanism is not triggered during the flooding of the vacuum chamber.

As a rule, the pouch made of the sheeting material is thermally sealed by pressing hot sealing bars onto the outer surfaces of the sheeting material until the polypropylene layers lying inside on top of one another are liquefied and are heat-sealed to one another. As a rule, sealing is carried out in vacuo inside a vacuum chamber. The pouch can, however, also be evacuated only on the inside by means of a suction device and then be sealed. In addition to the thermal contact method, it was found that sealing procedures by means of ultrasound are useful as well.

According to the present invention, it is possible to incorporate the fluid container to be cooled at a later time into a cooling element. To keep interfering gases out of the cooling element, this fluid container as such can be sealed into an evacuated pouch prior to incorporating it into the outer pouch. To ensure that no gases that interfere with the vacuum are released during the storage period as well as during the cooling time during which the temperatures are higher, all components contained in the vacuum should have been heated during the evacuation process to a temperature of at least 80° C. or should have been outgassed at even higher temperature prior to introducing them into the vacuum.

The preferred embodiments of the present invention, as well as other objects, features and advantages of this invention, will be apparent from the following detailed description, which is to be read in conjunction with the accompanying drawings.

DETAILED DESCRIPTION OF THE PREFERRED EMBODIMENTS

Figure 1:
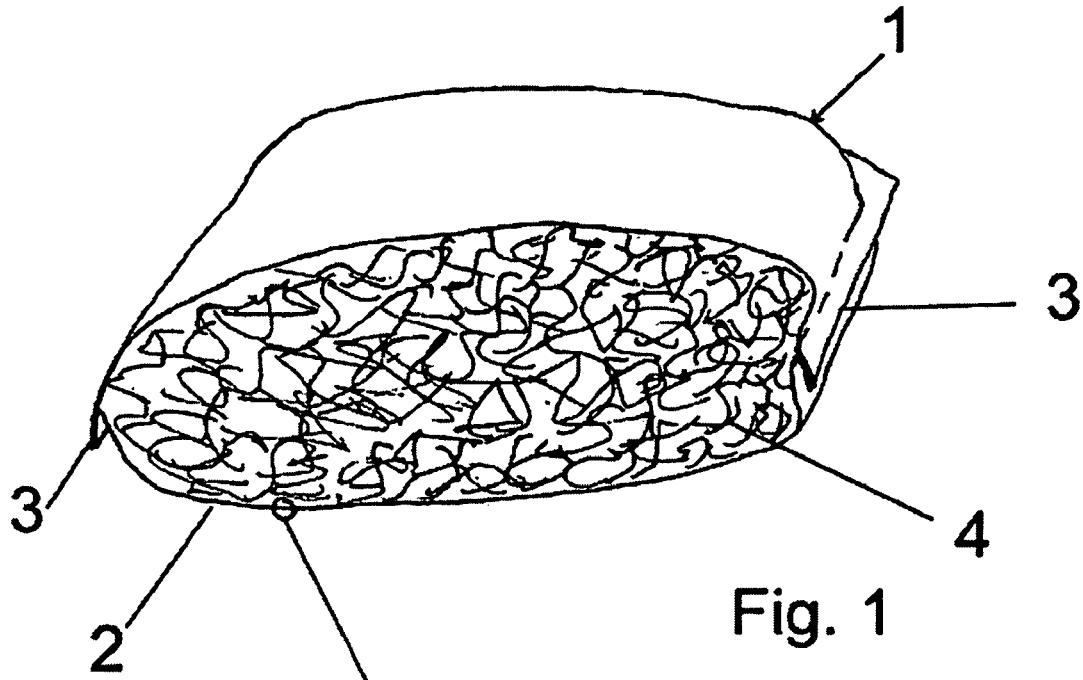
FIG. 1 shows a perspective and cross-sectional view of the pouch containing sorbent material.

The sorbent-containing pouch 1 shown as a perspective and cross-sectional representation in FIG. 1 comprises a multilayer sheeting material 2 that is thermally sealed along the edges 3 of the pouch. Located in the evacuated inside of said pouch is the desorbed sorbent material 4 which contains broken natural zeolite granules.

The multilayer sheeting material 2 previously sealed to form a pouch was filled with bulk granules that had been heated to 140-200° C. in a circulating air oven and was subsequently evacuated in a vacuum chamber to a pressure of less than 5 mbar. Both gases and water vapor were drained from the zeolites crystal structure by pumping. The sorbent-containing pouch 1 was sealed by means of sealing tongs so as to be impermeable to gas and the vacuum chamber was reaerated. The sorbent-containing pouch 1 was cooled by submerging it in a water bath. After cooling, the water vapor pressure inside the pouch is below 1 mbar absolute. Residual gases are not measurable and will not outgas later from the multilayer sheeting material since on filling the pouch with the hot granules, said sheeting material was heated to above 100° C. as well, thereby releasing potentially existing gases. When heated to a similar temperature level during the subsequent sorption process, no other interfering gases will be released.

Figure 1A:
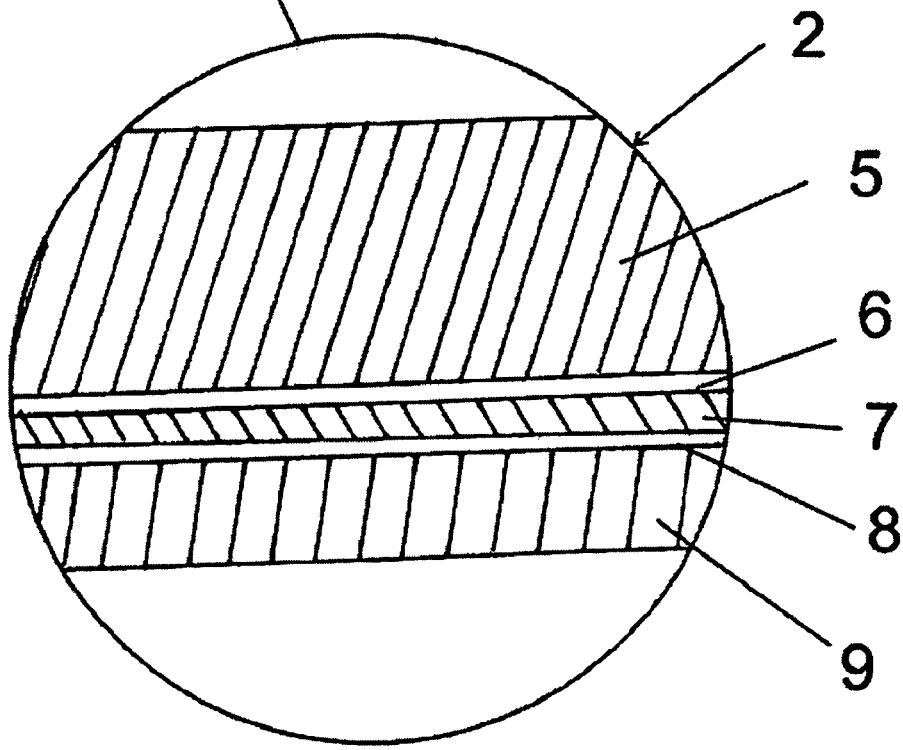
FIG. 1*a* shows an enlarged partial view of the multilayer sheeting material seen in FIG. 1.

FIG. 1*a* shows an enlarged cross-sectional view of the multilayer sheeting material 2. It comprises, from the inside out, an 80 μm thick polypropylene layer 5 on which an 8 μm thick aluminum layer 7 is glued by means of adhesive 6. By means of a second adhesive layer 8, a long-wearing 30 μm thick polyester layer 9 is attached. The choice of the layers and adhesives used is made on the basis of the requirements that in vacuo (i.e., in a vacuum) and at temperatures above 100° C., the layers do not release interfering gases, the sealed seams do not rupture and the sharp-edged zeolite-containing sorbent material 4 cannot puncture the sheeting material. According to the present invention, an additional polyester layer can be glued in between the polypropylene layer 5 and the aluminum layer 7.

Figure 2:
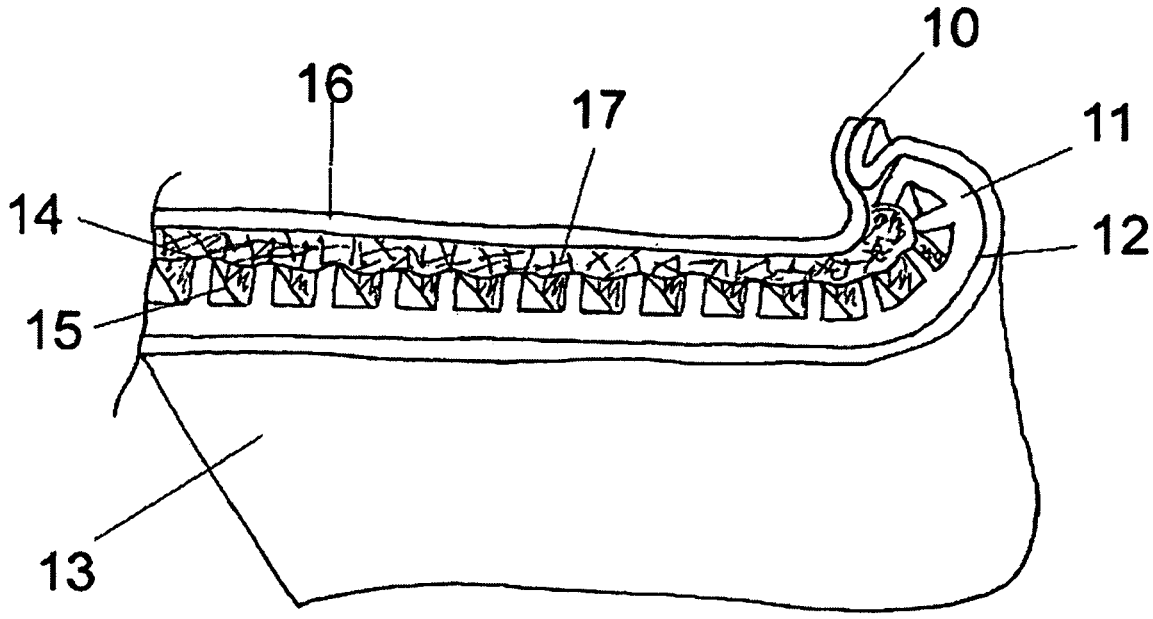
FIG. 2 shows a perspective and cross-sectional view of an evaporator assembly.

FIG. 2 shows a perspective and cross-sectional representation of an evaporator. Said evaporator comprises a spacer 11 which is manufactured from a flexible extrusion-molded polycarbonate part and which has a multilayer sheeting material 13 disposed on its smooth outer surface 12 and open flow passageways 15 for the working medium vapor on its structured inner surface 14. Interspersed between a second multilayer sheeting material 16 which covers the cold surface of the evaporator and the spacer 11 is a fibrous nonwoven material 17 which is saturated with the fluid working medium. The nonwoven material 17 comprises microfibers made of polypropylene. The two multilayer sheeting materials 16 and 13 are thermally sealed to each other along seam 10 having a sealed seam width of at least 5 mm.

Figure 3:
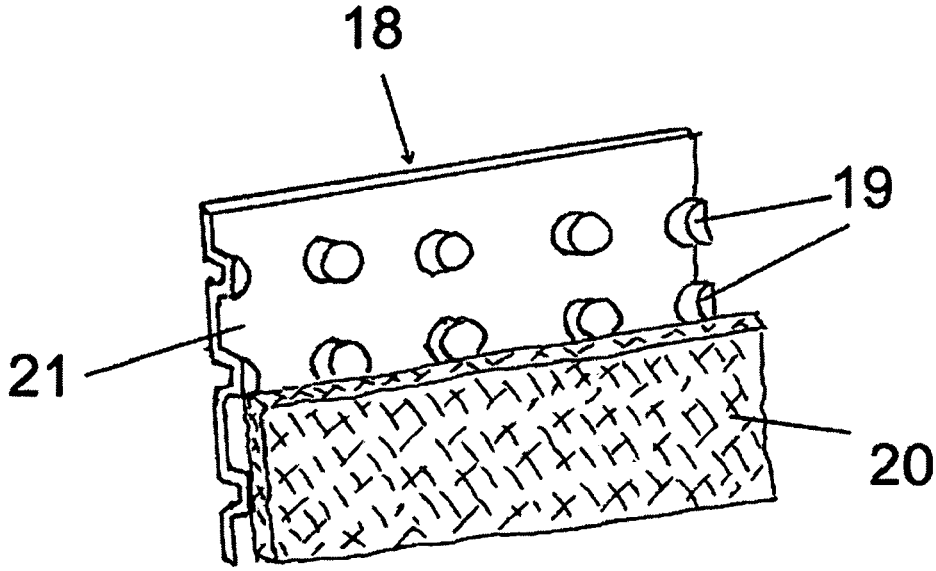
FIG. 3 shows a design of a spacer.

FIG. 3 shows a different embodiment of spacer 18. Said spacer is manufactured from a 1 mm thick polypropylene plate 21, into which spacer nubs 19 are thermoformed by means of a thermoforming method, which spacer nubs ensure that there is a space relative to a nonwoven material 20, thus allowing water vapor that evaporates from the nonwoven material 20—unimpededly flow in the passageway between the nonwoven material 20 and the polypropylene plate 21.

Figure 4:
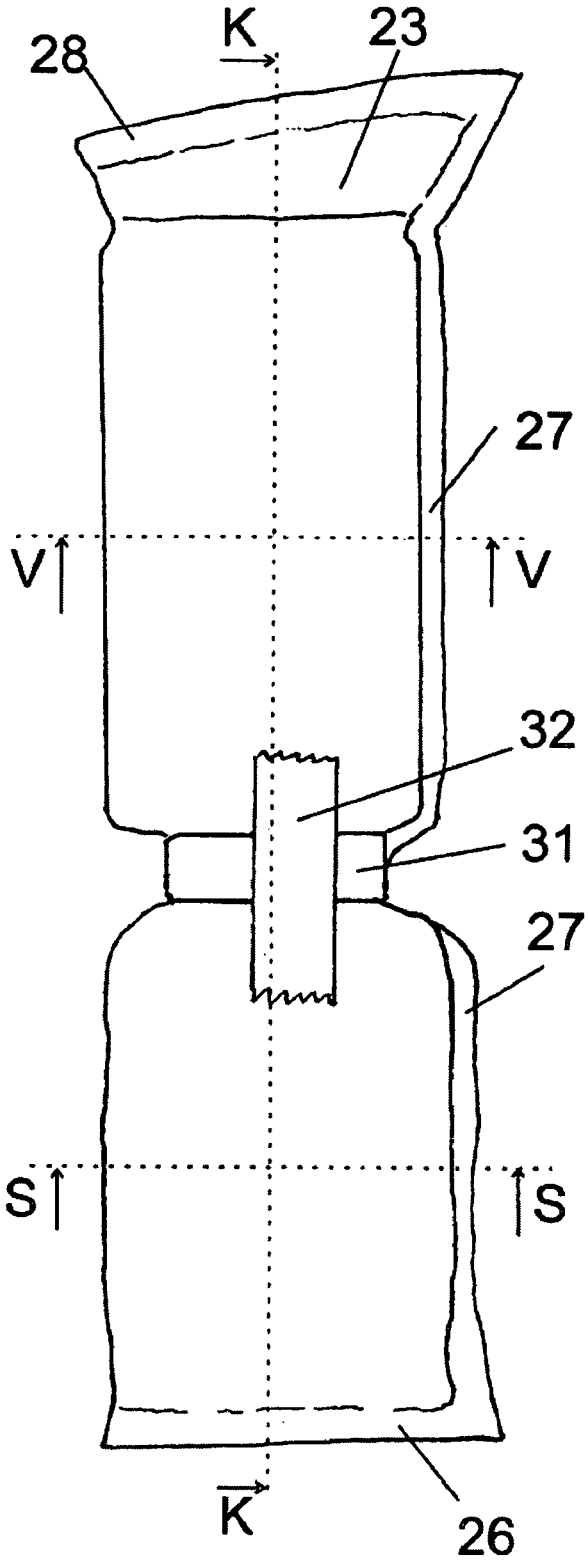
FIG. 4 shows a cooling element for cooling a beverage can.
Figure 4C:
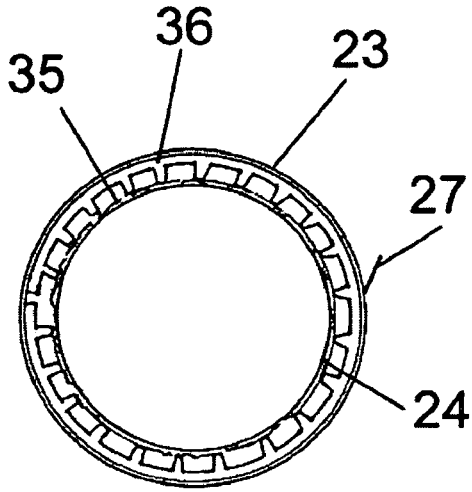
FIG. 4*c* shows the cooling element seen in FIG. 4 in another cross section along VV.
Figure 4B:
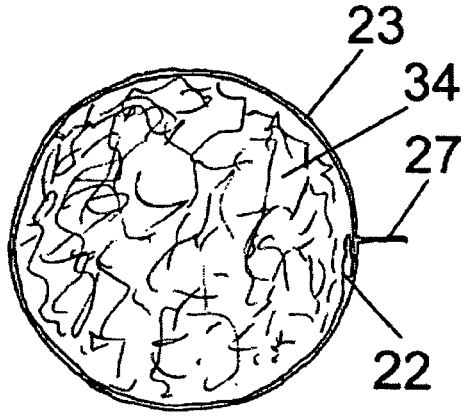
FIG. 4*b* shows the cooling element seen in FIG. 4 in a cross section along SS.
Figures 4A, 4D:
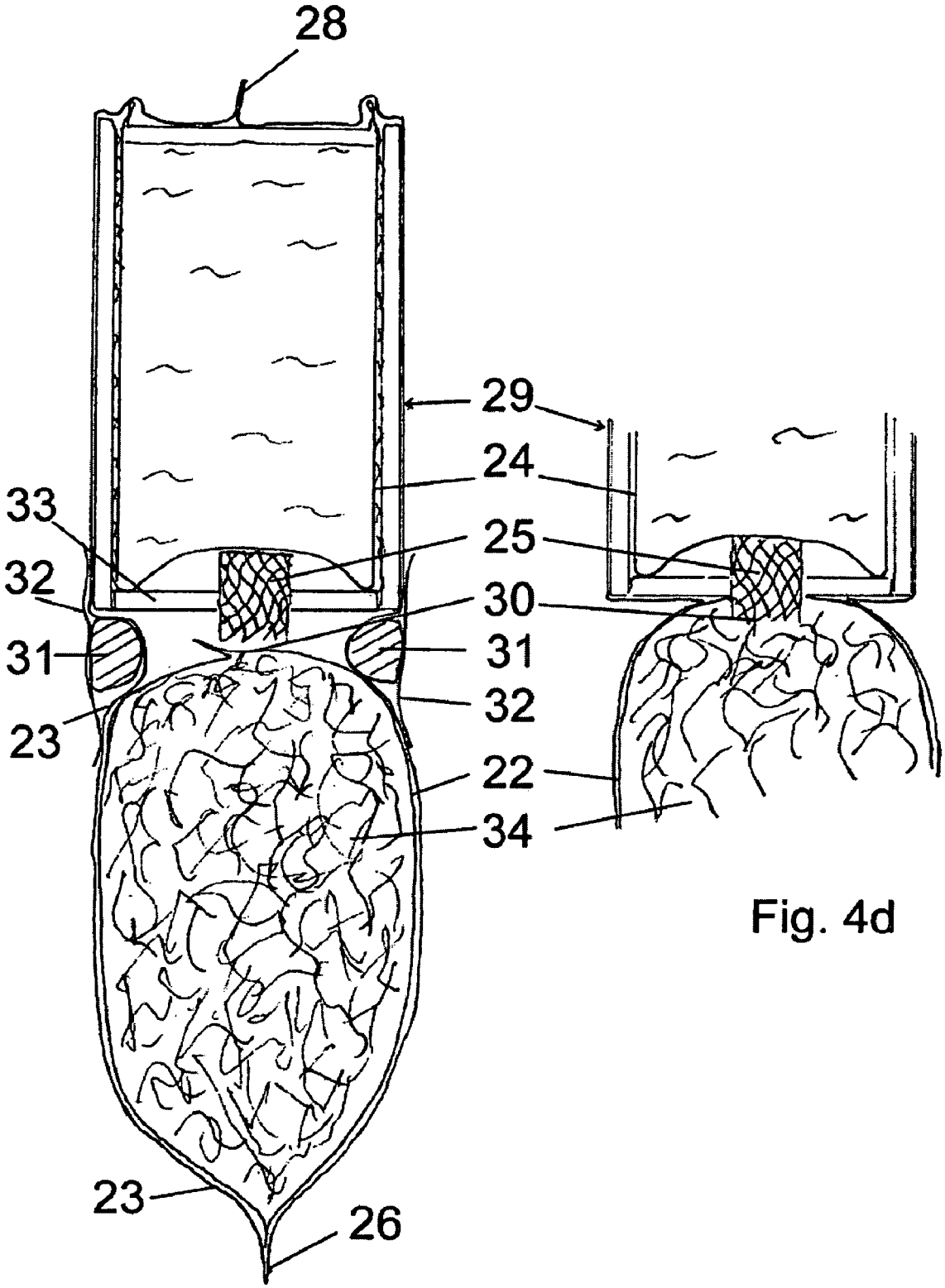
FIG. 4*a* shows the cooling element seen in FIG. 4 in a longitudinal section along KK.
FIG. 4*d* shows the cooling element seen in FIG. 4 with the vapor passageway opened.

FIGS. 4 and 4*a*-4*d* show a cooling element which holds a beverage can 24 with a volume of 0.5 L in the upper portion and a sorbent-containing pouch 22 with 400 g of natural clinoptilolite in the lower portion. The beverage can 24 and the sorbent-containing pouch 22 have been sealed in vacuo into an outer pouch 23. The outer pouch 23 is manufactured from a piece of a multilayer sheeting material which was folded over once and sealed along the lower cross seam 26 and along the long seam 27. After inserting the sorbent-containing pouch 22, a piercing tool 25 and the beverage can 24 surrounded by evaporator 29 into the outer pouch, said outer pouch 23 was subjected in a vacuum chamber to a pressure below the vapor pressure of the working medium and subsequently also sealed along the upper edge 28. To ensure that during the flooding of the vacuum chamber, the piercing tool 25 does not penetrate the sheeting material of the sorbent-containing pouch 22 at the piercing site 30 as a result of the contraction of the outer pouch 23, two spacers 31 made of expanded polypropylene are attached by means of adhesive tapes 32 to the outside of the outer pouch 23. The spacers 31 ensure that, in spite of the negative pressure, the piercing tool 25 does not pierce the sorbent-containing pouch 22. The flow passageway is opened only once the spacers 31 have been removed by tearing off the adhesive tapes 32 and once the piercing tool 25, as shown in FIG. 4*d*, has penetrated the sorbent-containing pouch 22 and has punched out the piercing site 30. The piercing tool 25 is manufactured from a small piece of expanded metal that has been molded to form a cylinder. On its upper end, it touches the beverage can 24; its lateral support is ensured by a fixing plate 33 with passageways, which fixing plate at the same time keeps the vapor path from evaporator 29 through the piercing tool 25 into the sorbent material 34 open once the spacers 31 have been removed.

FIG. 4*c* shows the construction of the evaporator 29 along cross section VV (seen in FIG. 4). Wrapped around the beverage can 24 is a paper sleeve 35 which is saturated with 30 g of water and which is pressed to the outer wall of the beverage can 24 by means of a spacer 36, similar to spacer 11 in FIG. 3. Spacer 36 in turn is pressed against the beverage can 24 by means of the outer pouch 23 on which the outside air pressure is exerted. This ensures an optimum thermal contact between the evaporating water and the content of the can.

FIG. 4*b* shows the cross section along line SS in FIG. 4. As explained in the description in connection with FIG. 1, the sorbent material 34, in this case natural zeolite, is packaged in the sorbent-containing pouch 22. The sorbent-containing pouch 22 is surrounded by the sheeting material of the outer pouch 23. Said sheeting material also comprises a barrier layer made of aluminum as well as a sealable layer made of polyethylene or polypropylene. As long as it is ensured that no gases exit from the surface or the cover seal of the beverage can 24 into the evaporator region, the beverage can 24 need not be surrounded by an additional gas-impermeable evacuated sheeting material.

During the manufacture of the cooling element, care should be taken to ensure that all media located within the vacuum system do not emit any gas or only harmless quantities of gas. Preferably, the sorbent-containing pouch 22 is first placed into the cover pouch 23. Subsequently, the spacers 31 are attached to the outside by means of adhesive tapes 32.

The paper sleeve 35 is wrapped around the lateral surface of the beverage can 24 and saturated with water as the working medium. Relative to the weight of the sorbent material, the water amounts to 7.5%. This is followed by the spacer 36 made of polypropylene and the fixing plate 33 into which the piercing tool 25 is inserted. The fixing plate 33 and the spacer 36 can be easily affixed to the beverage can 24 by means of shrink wrap (not shown in the drawing).

The thus prepared beverage can 24 is pushed into the outer pouch 23 until the two spacers 31 touch the fixing plate 33. The outer pouch 23 together with its contents is then evacuated in a vacuum chamber until a small quantity of water vapor flows from the working medium, here water. This working medium vapor flow outgases the working medium as such and also entrains all other gases from the outer pouch 23. After it has been ensured that all interfering gases have been evacuated by pumping, the outer pouch 23 is thermally sealed along the upper edge 28 by means of sealing bars.

After aerating the vacuum chamber, the finished cooling element can be removed. To ensure that even after a relatively long storage time, the cooling element is gas-impermeably sealed and no foreign gases were released, the element can again be placed into a vacuum chamber for evacuation. If the cooling element is properly functioning, the outer pouch 23 will bulge only once the pressure in the chamber drops below the pressure of the water vapor.

To activate the cooling element, it is necessary to remove the two spacers 31 which, because of the negative pressure, are securely clamped between the sorbent-containing pouch 22 and the fixing plate 33. Thanks to the flexible spacer material, the sheeting material of the outer pouch 23 and of the sorbent-containing pouch 22 is not damaged in spite of the presence of sharp-edged zeolite granules. As a result of the negative inside pressure, the piercing tool 25 will immediately penetrate the piercing site 30 of the sorbent-containing pouch 22, punch out a portion of the sheeting material and open up the vapor passageway for the waiting water vapor. Within a few minutes, the water in the paper sleeve 35 will cool to approximately 0° C., and the sorbent material 34 will be heated to more than 100° C. After approximately 10 min, the contents of the beverage can 24 will have cooled by approximately 18 K, and the sorbent material 34 will be uniformly hot. The beverage inside the can be cooled more rapidly by occasionally shaking the beverage can 24. The outer pouch 23 can be torn open by means of a notch on the sealed seam along long seam 27, and the cold beverage can 24 can be removed from the evaporator 29. The sorbent granules used can be utilized to improve the quality of the soil or stagnant water or, together with the sheeting material, can be disposed of with the residual waste.

Approximately 18 g of the water saturating the paper sleeve 35 have been evaporated and sorbed by the sorbent material 34. Given a weight of the zeolite filling of 400 g, this corresponds to a loading of only 4.5%. But since, within the short cooling time, the zeolite filling is not able to release much heat, a noticeable drop in temperature, and thus an additional water adsorption associated therewith, is not possible. For this reason, a natural zeolite is highly suitable for use in the cooling element described here.

Figure 5:
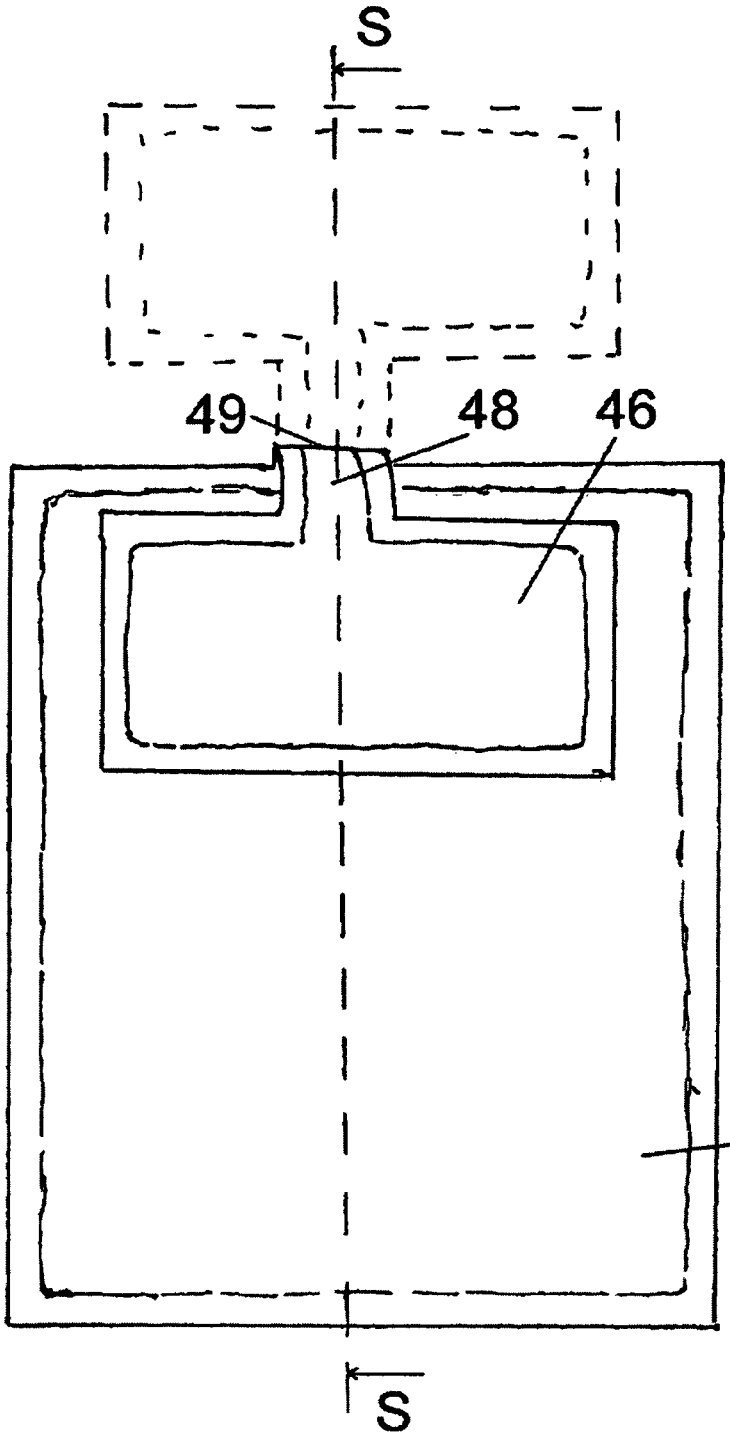
FIG. 5 shows a cooling element that can simultaneously cool and warm.
Figure 5A:
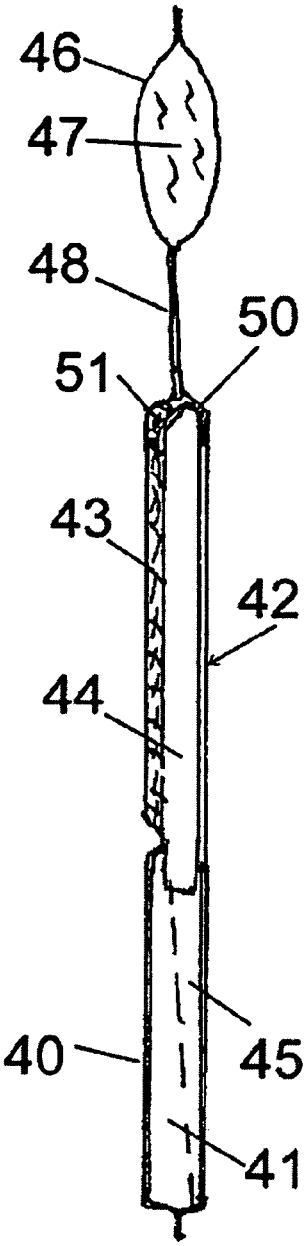
FIG. 5*a* shows the cooling element seen in FIG. 5 in a cross section along SS.

FIGS. 5 and 5*a* show a flat cooling element which, in addition to the cold from evaporator 42, also allows heat form the sorbent material to be utilized. A flat sorbent-containing pouch 40 comprises a zeolite plate 41 made of synthetic zeolite and an evaporator 42 without a shut-off means disposed in between. The evaporator 42 comprises an anhydrous nonwoven material 43 and a spacer 44 having a construction identical to the spacer of FIG. 2. The zeolite plate 41 has been formed from powdered Na-A zeolite with an added binding agent. Disposed in the lower part of said zeolite plate are flow passageways 45 which make it possible for the water vapor flow to move from the spacer 44 into the sorbent material. The water used as the working medium 47 is located in a water pouch 46 which is connected by way of a connecting passageway 48 with the evaporator 42 and which, at the same time, is an integral part of the sorbent-containing pouch 40. Disposed in the area in which the connecting passageway 48 opens out into the evaporator 42 is a piece of sheeting material 50 which ensures that inflowing water is directed into the nonwoven material 43 and does not reach the flow passageways of the spacer 44 while still in a liquid state. In addition, in the area of the mouth of the connecting passageway 48, 0.5 g of common salt has been incorporated into the nonwoven material 43. According to the present invention, a single pouch of a multilayer sheeting material is used; this pouch encloses and forms the sorbent material, the evaporator 42, the connecting passageway 48, the water as the working medium, here water, 47, and the shut-off means. The shut-off means is implemented in that the connecting passageway 48 is kinked at an angle of 180° upward from its originally plane position. Thus, during the storage time, the water pouch 46 which, during manufacturing, is in the position shown as a broken line in FIG. 5 is disposed on the evaporator 42. As a result of the sharp fold 49 in the area of which the two superimposed polypropylene layers are tightly squeezed against each other, a very inexpensive shut-off means has been created, which shut-off means (by folding the water pouch 46 back into its original position (position shown as a broken line in FIG. 5 and position in FIG. 5*a*)) can be easily opened without the need for an additional tool simply be exerting pressure on the outside of the water pouch 46.

To manufacture the cooling element, the zeolite plate 41 is heated in a circulating air oven to temperatures between 150° C. and 200° C. The hot zeolite plate 41, together with the evaporator components that have been heated to approximately 80° C., is subsequently introduced into the partially pre-manufactured sorbent-containing pouch 40. The sorbent-containing pouch 40 is subsequently sealed so that only the connecting passageway to the water pouch 46 and the water pouch itself have a suction opening to a vacuum chamber. By evacuating the vacuum chamber to less than 5 mbar, the pressure within the sorbent-containing pouch 40 is reduced as well. This causes residual water to evaporate from the zeolite, the vapor flow of which residual water eliminates air and gases released from the hot components through the connecting passageway 48. Thereupon, the passageway can be folded. The water pouch 46 can now be filled with outgassed water and can subsequently be sealed so as to be impermeable to gas.

To activate the cooling element, the water pouch 46 is simply folded back into its original position and thus the fold 49 is straightened out. Driven by the water vapor pressure in the water pouch 46, water now flows through the connecting passageway 48 into the nonwoven material 43. This water dissolves the salt crystals located in said material, which lowers the freezing point to nearly −17° C. The water that follows directs the salt solution into the nonwoven material, from which it can evaporate. The vapor is deflected via the passageways that are kept open by the spacers 44 and directed into the zeolite plate 41 and exothermally sorbed. The heat of sorption heats the zeolite plate 41 to more than 100° C. The nonwoven material 43 is cooled by the cold of evaporation to temperatures below the freezing point. Thus, in the area of the zeolite plate 41, the cooling element can be used, for example, to keep food warm, and in the area of the evaporator 42, it can be used to keep beverages cold. After use, it can be disposed of with the residual waste.

Although not shown in the drawing, it should be noted that the evaporator 42 of the cooling element seen in FIG. 5 can be shaped in the form of a cylinder which is suitable for holding a can or a bottle. To ensure good thermal contact between the outer surface of the bottle and the sorbent-containing pouch, the two can be compressed to each other by means of stretch wraps or rubber bands.

The bottle and the cooling element can also be very efficiently brought into contact with each other by placing both into an additional pouch which is subsequently evacuated. In this case, the heat transfer from the evaporator to the bottle is considerably improved as a result of the air pressure exerted on the pouch.

Figure 6:
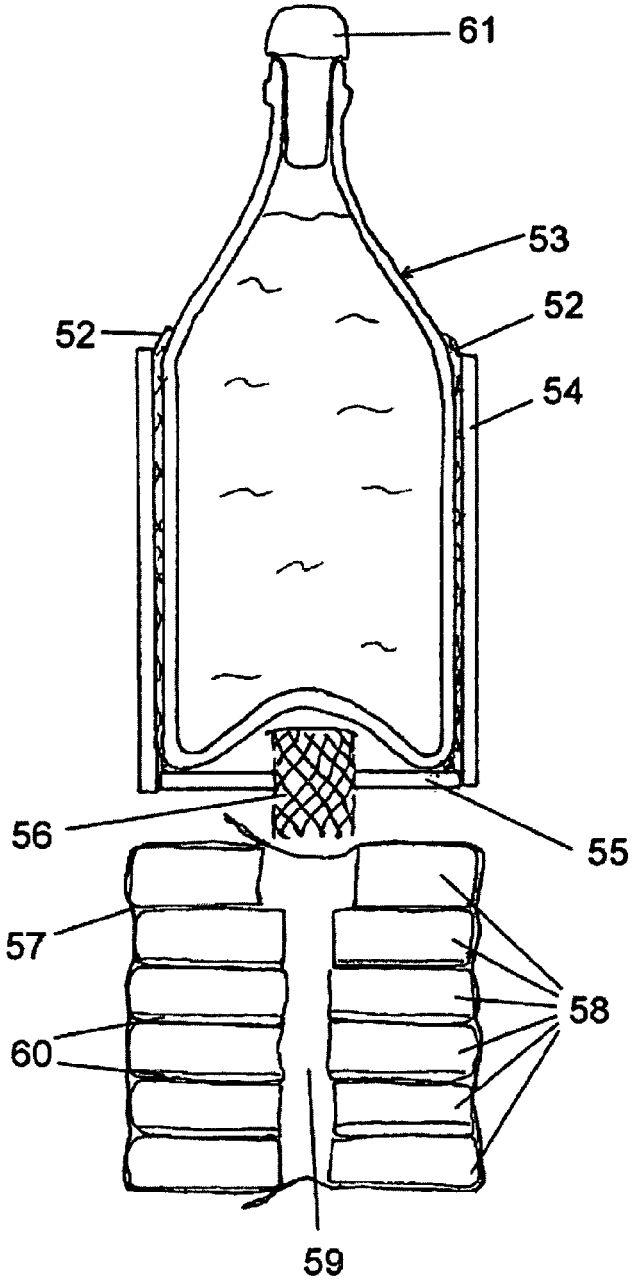
FIG. 6 shows a cooling element assembly for cooling a bottle.
Figure 6A:
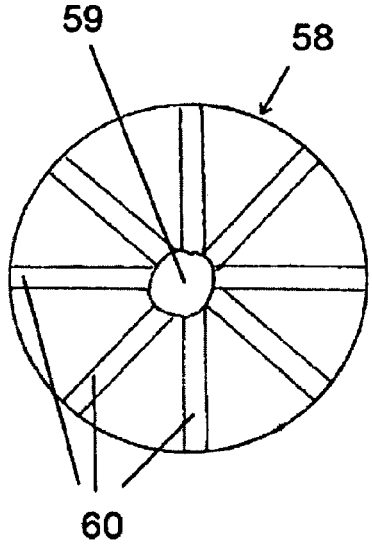
FIG. 6*a* is a top view of a zeolite plate seen in FIG. 6.

FIG. 6 shows additional components of a cooling element according to the present invention for rapidly cooling a bottle 53 that is filled with a beverage. The bottle 53 which is shown in cross section is again surrounded by a cylindrically moldable spacer 54, which presses a nonwoven material 52 onto the cylindrical portion of the bottle, and by a fixing element 55 for holding a cutting tool 56. The bottle 53 itself can first be sealed into a gas-impermeable evacuated sheeting material (not shown) to ensure that gases diffusing from the cork 61 of the bottle 53 cannot interfere with the vacuum needed for proper functioning of the cooling element. A sorbent-containing pouch 57 comprises 6 disk-shaped zeolite plates 58, a top view of one of which plates is shown in FIG. 6*a*. Disposed in the center of the plates are vapor passageway holes 59, via which the water vapor is transported to the radial passageways 60. From the radial passageways, the vapor can subsequently advance rapidly into all areas of the sorbent material by way of narrow gaps which inevitably remain between the plates. The uppermost plate 58 has a larger vapor passageway hole to accommodate the cutting tool 56 and the multilayer sheeting material that is punched out.

The other components necessary for the proper functioning of the cooling element according to the present invention are not shown in the drawing. These components follow from and are identical to those in the drawings and descriptions of FIGS. 4-4*d*.

Figure 7:
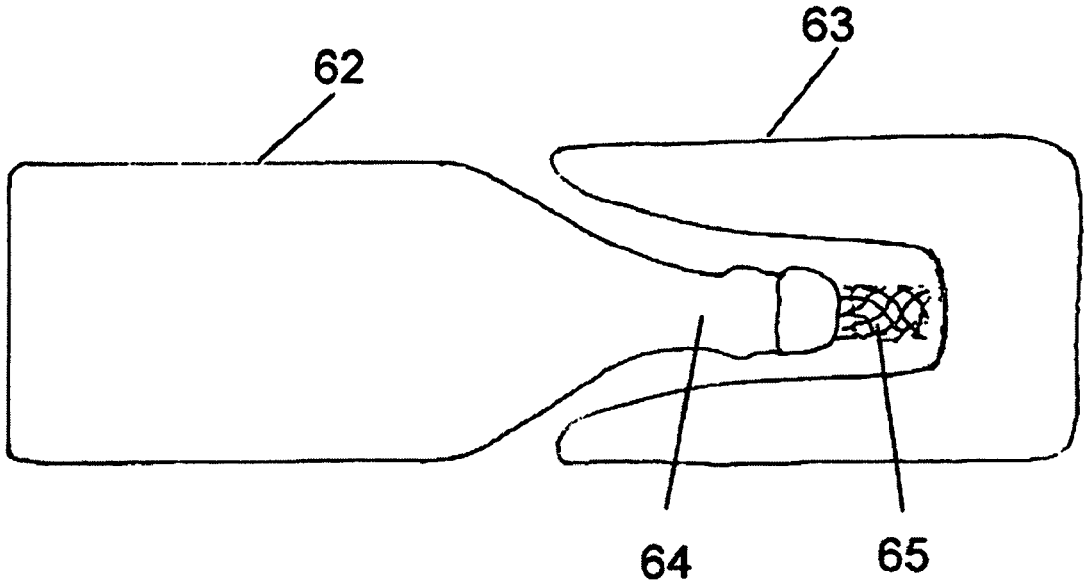
FIG. 7 shows another assembly of a pouch containing the sorbent material and a bottle to be cooled.

FIG. 7 shows another compact configuration of a cooling element for cooling a bottle 62. Molded into the sorbent-containing pouch 63 is a depression in which the neck 64 of the bottle and the shut-off means 65 are disposed. The sorbent-containing pouch 63 preferably has the diameter of the bottle 62, including the evaporator which is not shown in the drawing. The shut-off means is a cutting tool 65 which can perforate the multilayer sheeting material of the sorbent-containing pouch 63 only after manually increased axial pressure has been exerted. Again, for clarity's sake, the remaining components are not shown in the drawing. These components as well as the manufacturing and cooling method follow from the description in connection with FIGS. 4-4*d*.

Figure 8:
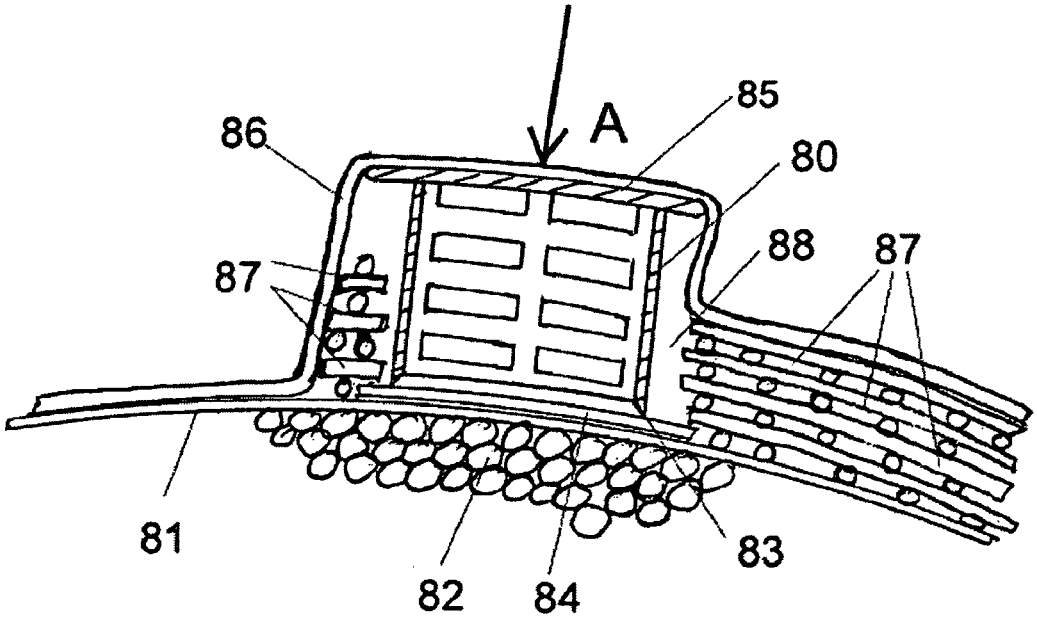
FIG. 8 shows a sectional view of a shut-off means with a cutting die.

FIG. 8 shows a shut-off means with a cutting die 80 that can perforate a sorbent-containing pouch 81. The sorbent-containing pouch 81 contains a zeolite filling 82 in the form of beads. Disposed on one end of the cylindrically shaped cutting die 80 is a knife edge 83 which is designed to pierce the sheeting material of the sorbent-containing pouch 81. To safeguard against accidental cutting, a protective sheeting material 84 is placed between the knife edge 83 and the sorbent-containing pouch 81, the properties of which protective sheeting material are such that they ensure that the cutting die 80 pierces the sorbent-containing pouch 81 only when additional external forces are exerted in the direction of arrow A on the other end of the cutting die 80, thereby eliminating the possibility that the external air pressure alone activates the cutting die. Disposed on this other end is a cap 85 which projects beyond the diameter of the cutting die 80 and which supports the outer pouch 86. The diameter of cap 85 is slightly larger than the punched-out hole 88 in a passageway for the working fluid vapor, which passageway is disposed between the sorbent-containing pouch 81 and the outer pouch 86. To maintain the necessary vapor cross section, the passageway is constructed of a plurality of layers of a network 87 of polypropylene filaments. As a result of this multilayer construction, the flow diameter for the working fluid vapor within the network structure remains sufficiently large, although the difference between the pressure of the working fluid vapor and the external air pressure is acting on the vapor passageway. By exerting pressure on the outer pouch 86 in the direction of arrow A, the protective sheeting material 84, together with the sorbent-containing pouch, is pierced by the knife edge 83 of the cutting die 80. The zeolite filling 82 that follows pushes the punched-out portions into the inside of the cutting die cylinder and thus opens up the passageway for the vapor. The cutting die 80 can be pushed in until its cap 85 comes to rest on the perforated edges of the networks 87. The flexible outer pouch 86 folds without becoming permeable.

Although the preferred embodiments of the present invention have been described with reference to the accompanying drawings, it is to be understood that the invention is not limited to those precise embodiments, and that other changes and modifications may be made by one skilled in the art without departing from the scope or spirit of the invention.

What is claimed is:

1. A method for initiating a cooling function of a cooling element having a sorbent material which in vacuo can sorb a vaporous working medium that evaporates from a fluid working medium in an evaporator, the cooling element further including a shut-off means for preventing the working medium vapor from flowing into the sorbent material up to the moment at which the cooling process is initiated, wherein the sorbent material is sealed into a sorbent-containing pouch which comprises a multilayer sheeting material which in turn comprises at least one metallic layer or one metalized layer, and wherein the shut-off means is triggered by manually deforming a flexible, gas-impermeable outer pouch, wherein external spacers are removed from the cooling element to deform said outer pouch and wherein the sorbent-containing pouch is pulled by a negative pressure against a cutting tool.

2. A method for initiating the cooling function of a cooling element as defined in claim 1, wherein a fold within the sorbent-containing pouch is smoothed out, as a result of which the fluid working medium can flow from the water pouch into the evaporator.

3. A sorption cooling element comprising:

a flexible sorbent-containing inner pouch made from a multilayer sheeting material, said multilayer sheeting material including at least one metallic layer or one metalized layer;

a sorbent material contained within said sorbent-containing pouch;

an evaporator;

a fluid working medium contained within said evaporator;

a shut-off means preventing said fluid working medium from flowing into said sorbent material; and a flexible and gas-impermeable outer pouch enclosing said inner pouch, said evaporator and said shut-off means, said flexible and gas-impermeable outer pouch being deformed, wherein said shut-off means opens said inner pouch upon said outer pouch being deformed to permit a vaporous working medium evaporating from said fluid working medium in said evaporator to flow into said sorbent-containing pouch, wherein said sorbent material sorbs in vacuo said vaporous working medium that evaporates from said evaporator, and wherein said flexible and gas-impermeable outer pouch is being deformed by an interaction between negative pressure within the outer pouch and external air pressure.

4. The cooling element as defined in claim 3, wherein the multilayer sheeting material comprises a polyester layer with a layer thickness between 12 and 50 μm.

5. The cooling element as defined in claim 3, wherein the multilayer sheeting material comprises a polypropylene layer with a layer thickness between 50 and 100 μm.

6. The cooling element as defined in claim 3, wherein the multilayer sheeting material can be sterilized at temperatures up to 120° C.

7. The cooling element as defined in claim 3, wherein the sorbent material contains zeolite.

8. The cooling element as defined in claim 3, wherein the shut-off means comprises a cutting tool suitable for piercing the multilayer sheeting material.

9. The cooling element as defined in claim 3, wherein the outer pouch also encloses a container, the container containing contents which are to be cooled.

10. The cooling element as defined in claim 3, wherein the outer pouch is shaped and sealed in such a manner that it forms an evaporator portion and a water pouch, and wherein the shut-off means comprises a connecting passageway connecting the water pouch to the evaporator portion.

11. The cooling element as defined in claim 3, wherein the shut-off means comprises a cutting tool which is disposed between the outer pouch and the sorbent-containing pouch and which, on exertion of an external force, pierces the sorbent-containing pouch and thus opens up the passageway for the flow of working medium vapor into the sorbent material filling, without the outer pouch becoming permeable.

12. The cooling element as defined in claim 3, wherein the passageway for the working medium vapor is formed by flexible plastic networks which, in layers, are superimposed on top of one another and which are able to withstand an excess amount of external pressure.

13. The sorption cooling element as defined in claim 3, wherein said shut-off means comprises a cutting tool, said cutting tool piercing said multilayer sheeting material of said sorbent-containing pouch upon said outer pouch being deformed.

14. The sorption cooling element as defined in claim 3, wherein said shut-off means is disposed outside of said sorbent-containing inner pouch prior to opening said inner pouch and opens said sorbent-containing inner pouch by piercing said inner pouch from the outside of said inner pouch.

15. A sorption cooling element comprising:

a sorbent-containing pouch made from a multilayer sheeting material, said multilayer sheeting material including at least one metallic layer or one metalized layer;

a sorbent material contained within said sorbent-containing pouch;

an evaporator;

a fluid working medium contained within said evaporator;

a shut-off means preventing said fluid working medium from flowing into said sorbent material;

a flexible and gas-impermeable outer pouch enclosing said evaporator and said shut-off means, said flexible and gas-impermeable outer pouch being deformable; and an external spacer, said spacer being removable from the cooling element to deform said outer pouch wherein said shut-off means opens upon said outer pouch being deformed to permit a vaporous working medium evaporating from said fluid working medium in said evaporator to flow into said sorbent-containing pouch, wherein said sorbent material sorbs in vacuo said vaporous working medium that evaporates from said evaporator, and wherein said flexible and gas-impermeable outer pouch is deformed by an interaction between negative pressure within the outer pouch and external air pressure.

* * * * *